US005498067A

United States Patent [19]

Christenson

[11] Patent Number: 5,498,067

[45] Date of Patent: Mar. 12, 1996

[54] LIFTING LATCH HINGE FOR TAILGATE ON REFUSE HAULER/COMPACTOR

[75] Inventor: Ronald E. Christenson, Kasson, Minn.

[73] Assignee: McNeilus Truck and Manufacturing, Inc., Dodge Center, Minn.

[21] Appl. No.: 182,714

[22] Filed: Jan. 14, 1994

[51] Int. Cl.[6] ..... B65F 03/28

[52] U.S. Cl. ..... 298/23 MD; 298/23 S

[58] Field of Search ..... 298/23 MD, 23 S; 296/56

[56] References Cited

U.S. PATENT DOCUMENTS

| | | | |
|---|---|---|---|
| 3,257,012 | 6/1966 | Berolzheimer . | |
| 3,272,552 | 9/1966 | Park . | |
| 3,402,837 | 9/1968 | Palmer et al. . | |
| 3,440,763 | 4/1969 | O'Brien . | |
| 3,696,951 | 10/1972 | Toppins et al. . | |
| 3,819,071 | 6/1974 | Liberman . | |
| 3,830,542 | 8/1974 | Lablanche | 298/23 MD X |
| 3,899,091 | 8/1975 | Smith . | |
| 3,990,739 | 11/1976 | Head | 298/23 S X |
| 4,109,963 | 8/1978 | Sieving et al. . | |
| 4,194,787 | 3/1980 | Williamsen . | |
| 4,382,740 | 5/1983 | Smith . | |
| 4,427,231 | 1/1984 | Smith . | |
| 4,538,951 | 9/1985 | Yeazel et al. . | |
| 4,552,500 | 11/1985 | Ghibaudo et al. . | |
| 4,568,237 | 2/1986 | Krause et al. . | |
| 4,627,783 | 12/1986 | De Filippi . | |
| 4,648,775 | 3/1987 | Verner . | |
| 4,665,649 | 5/1987 | Hund, Jr. . | |
| 4,877,366 | 10/1989 | De Filippi . | |
| 4,892,454 | 1/1990 | Behling et al. . | |
| 5,143,496 | 9/1992 | Smith et al. | 298/23 MD X |
| 5,190,433 | 3/1993 | Boda . | |

*Primary Examiner*—William E. Terrelll
*Assistant Examiner*—Janice L. Krizek
*Attorney, Agent, or Firm*—Haugen and Nikolai

[57] ABSTRACT

A combination lifting hinge and latching mechanism for a tailgate used on a refuse hauler and compactor. A hydraulically operated lifting hinge is comprised of three principle components, namely, a hydraulic cylinder, a bell crank and a cam plate secured to the tailgate. A pair of lifting assemblies is disposed at an upper location each side of the cylindrical compactor body such that it is not easily damaged, and further, allows the compactor body to extend laterally and vertically to the maximum highway guidelines. The lifting mechanism first lifts the tailgate from the locking position such that locking pins clear side spur latches before rotation. Due to the unique camming feature and a kidney-shaped slot in the cam plate, an over-center locking feature is provided. The tailgate cannot be inadvertently lifted from a locked position due to upward forces, such as the truck hitting a bump, even if the actuating cylinder should relax its holding forces, such as during a hydraulic failure.

12 Claims, 8 Drawing Sheets

LIFTING LATCH HINGE FOR TAILGATE ON REFUSE HAULER/COMPACTOR

BACKGROUND OF THE INVENTION

I. FIELD OF THE INVENTION

This invention is related generally to refuse hauling truck bodies, and more particularly to a truck body having a tailgate which is hinged from a latched closed position to an open position when refuse is discharged from the truck compactor body.

DISCUSSION OF THE PRIOR ART

Refuse collection is a time consuming and expensive operation. The costs associated with using landfills are constantly increasing, as are the costs for operating the heavy equipment used to collect and transport refuse to the landfill site. Accordingly, refuse truck manufacturers design refuse collector bodies to be very large to reduce the number of runs to the landfill, but within the height and width guidelines of truck bodies set by the Department of Transportation.

One type of prior art refuse collection truck comprises a cylindrical refuse collector body having a dish-shaped tailgate which is hinged outwardly to expose the contents of the collector body. Refuse compacted within the refuse compactor body is discharged therefrom using a conventional hydraulically driven ram. Prior art lifting and hinging mechanisms which swing the tailgate clear of the refuse to be discharged are complicated, expensive, and consume valuable space thus limiting the allowable height and width of the refuse collection chamber while the overall collection body still meets the transportation highway guidelines. For instance, some prior art lifting mechanisms comprise a pair of hydraulic cylinders disposed in the vertical direction or each side of the tailgate for lifting the tailgate upwardly. These vertically oriented cylinders protrude laterally from the collection body, and must remain within the highway width guidelines. Further, these cylinders cannot extend vertically more than 11½ feet above the ground surface to meet the highway guidelines.

In addition to providing a lifting mechanism for the tailgate assembly, locking or latching mechanisms are usually provided such that the tailgate cannot inadvertently become separated from the compactor body thus allowing refuse to be inadvertently discharged therefrom. Modern compaction apparatuses generate large compression forces on the refuse such that refuse is compacted into as small a volume as possible. Thus, tailgates need to be secured to the compactor body to withstand the great forces the refuse is exerting on the inner surface of the tailgate. Prior art lifting mechanisms have attempted to provide combination lifting and latching assemblies, but these prior art apparatuses are typically complicated, expensive, and occupy valuable space which reduces the allowable size of a compactor body while meeting the highway guidelines.

One such prior art device is taught in U.S. Pat. No. 4,665,649 which teaches a gate operator and latch mechanism for refuse containers. This patent discloses a lifting mechanism comprised of a pair of vertically oriented hydraulic cylinders which form an intricate portion of a latch assembly. These hydraulic cylinders are laterally disposed on opposite sides of the compactor body. Accordingly, the compactor body has a width less than that allowed by highway guidelines due to the additional cylinders disposed on each side thereof.

Similarly, a pair of vertically oriented lifting hydraulic cylinders are taught for operation with tailgate assemblies in U.S. Pat. No. 4,427,231 and U.S. Pat. No. 3,440,763. Again, as each of these cylinders are disposed on lateral portions of the tailgate assembly, the assembly disposed therebetween must meet the highway guidelines in combination with the cylinders.

U.S. Pat. No. 3,272,552 teaches a latch and tailgate operating mechanism for truck bodies having an intricate latch mechanism. To facilitate a combination latching mechanism, a plurality of parts are required. These parts require servicing, are relatively expensive to make due to the multiple parts required.

U.S. Pat. No. 4,877,366 teaches a refuse vehicle having a pair of tailgate cylinders that are operated to unlatch tailgate locks before raising the tailgate. Again, these cylinders are disposed on lateral walls of the compactor body which reduces the available volume therebetween for storing refuse.

OBJECTS

It is accordingly a principal object of the present invention to provide a combination lifting and latching mechanism for refuse body tailgates which can be used with a refuse container body extending to the maximum width and height requirements allowed by the Federal Highway Guidelines.

It is a further object of the present invention to provide a novel combination lifting and latching hinge which incorporates only a few key components, yet which operates efficiently to first unlatch and then lift the tailgate assembly to facilitate discharging the refuse contained therein.

Still yet a further object of the present invention is to provide a lifting mechanism disposed on the upper portion of the compactor body to reduce the likelihood that the lifting mechanism can become damaged by operating personnel, or by the compactor body being brushed against a surface which might otherwise scrape or damage the lifting cylinders.

Another object of the present invention is to provide a combination lifting and hinging mechanism with an integral over-center locking mechanism when fully closed.

Still yet another object of the present invention is to provide a combination lifting and hinging mechanism which can be easily and inexpensively retrofitted to existing refuse truck compactor bodies.

Other objects, features and advantages of the present invention will become apparent to those skilled in the art through the Description of the Preferred Embodiment, Claims, and drawings herein wherein like numerals refer to like elements.

SUMMARY OF THE INVENTION

The foregoing objects and advantages are achieved by providing a refuse truck body having a combination lifting and hinging mechanism securingly attached to the upper surface of the compactor body which includes a pair of hydraulic lifting cylinders normally residing in a near horizontal position, wherein the lifting mechanism has an integral latching mechanism.

More specifically, the combination lifting and latching mechanism comprises a storage body for storing refuse, and a tailgate coupled to the storage body for pivotable movement between an open and closed position. The tailgate forms a closure with the storage body in its closed position. A pair of hinging mechanisms are provided on the storage body upper surface for extending the tailgate between the open and closed position. Each hinging mechanism comprises a rigid L-shaped arm having a midsection pivotably attached to an upper portion of the storage body to define a pivot point. The arm has a proximal end and a distal end disposed on opposite sides of the respective pivot point. The arm distal end is pivotably connected to a respective upper portion of the tailgate. A lifting mechanism, such as a hydraulically operated cylinder, is pivotably connected to the upper portion of the storage body at one end and the cylinder piston to the arm distal end at the other end. The cylinder piston extends therebetween for pivoting the respective arm counterclockwise about the respective pivot point to extend the tailgate from the closed to the open position. Preferably, the pair of arms and hydraulic cylinders are provided on each side of the cylindrical storage body upper surface to minimize the height clearance.

Each arm is comprised of a bell crank pivotably secured between a pair of pivot plates, each plate secured to the compactor body upper surface. Each hydraulically operated cylinder is pivotably secured to the compactor body on one end with the other end pivotably secured to the bell crank proximal end. A pair of vertically oriented cam plates are each secured to the respective upper portion of the tailgate assembly. Each pair of cam plates are functionally coupled to the respective bell crank about the fixed pivot point and the respective bell crank distal end. A pair of slots are provided in each cam plate, one receiving the pivot pin forming the fixed pivot point, and the other receiving a lower cam shaft rotatably disposed through the bell crank distal end.

During extension of the hydraulically operated cylinder pistons, the pivot and cam shaft in combination with the cam slots cause the tailgate to be first lifted upwardly thus freeing a pair of locking pins or spurs at a lower portion thereof. These pins are normally received within a latching loop secured to the truck body frame. Subsequently, the cam plates operate in conjunction with the bell crank to lift and swing the tailgate outwardly and upwardly, wherein the latching pins swing clear of the respective frame latch loop. The hydraulically operated cylinder piston continues to extend in a smooth and continuous movement such that the cylinder remains generally horizontal while rotating the bell crank to pivot the tailgate upwardly.

The cam plate slot receiving the cam shaft, which cam shaft is also disposed through the bell crank distal end, is laterally extending and has a generally kidney-shape. This kidney-shaped slot facilitates the initial lifting action of the tailgate in the vertical direction to unlatch the tailgate before pivoting the tailgate upwardly and outwardly. Moreover, this kidney-shaped slot provides an over-center locking mechanism. When the tailgate is fully closed, the cam shaft is positioned in the slot left of a center shoulder, and the tailgate won't accidentally open if an upward force acts on the tailgate, i.e., if the truck hits a bump. The cam slot defined about the fixed pivot point of the bell crank is elongated and extends in generally the vertical direction and is angled slightly to the one o'clock position when the tailgate is in a locked position.

Only three essential functioning components are required for each lifting and hinging mechanism with an integral over-center locking mechanism. Specifically, a hydraulic extension cylinder, a bell crank, and a pair of cam plates. Accordingly, the present invention is reliable, easy to manufacture, and relatively inexpensive.

DESCRIPTION OF THE PREFERRED EMBODIMENT

Figure 1:
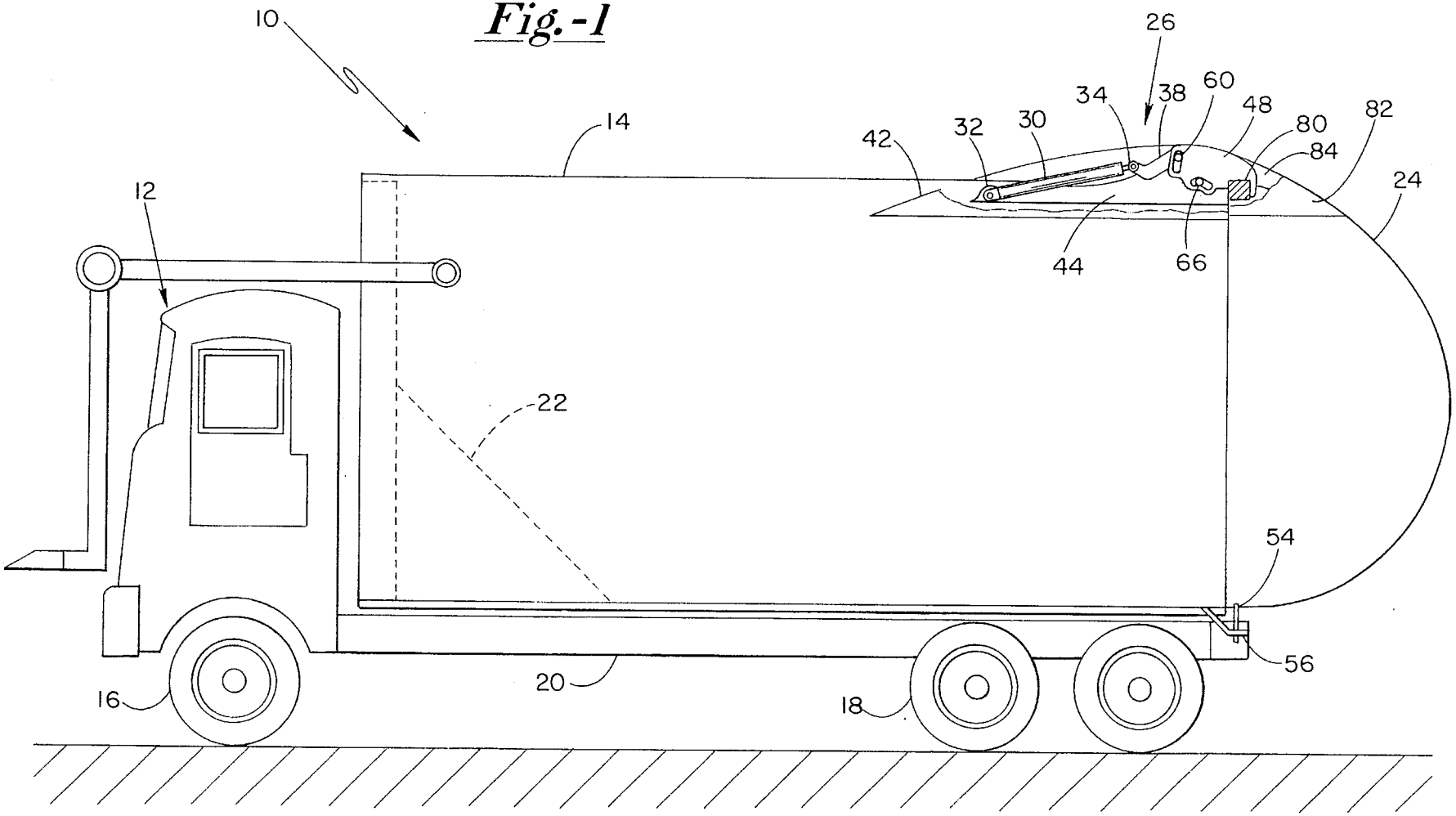
FIG. 1 is a side elevational view of a refuse truck illustrating one combination lifting and hinging mechanism disposed on an upper surface of the compactor body, wherein the tailgate is in the locked and closed position.

Referring to FIG. 1, a front-loading refuse hauling truck is generally shown at 10. Refuse truck 10 includes a truck body or chassis 12 complete with an engine and a cylindrical refuse compactor body shown at 14. The truck chassis 12 itself may be of a class of conventional refuse-hauling type chassis including a steerable front-axle assembly complete with wheels, etc. illustrated at 16, and a two-axle rear suspension as illustrated at 18 connected by a relatively heavy box-supporting frame 20 which is also conventional for such vehicles. A conventional refuse ejection pusher is shown in phantom at 22 which is operated by a hydraulic cylinder (not shown) in a well known manner. Compactor body 14 further includes a hinging dish-shaped tailgate 24 which is hinged upwardly to permit access to the contents of compactor body 14 such that refuse can be ejected using ejection assembly 22. A combination tailgate hinging and lifting mechanism is generally shown at 26 for selectively unlatching and hinging tailgate 24 upwardly prior to a refuse discharging procedure. A lifting and hinging assembly 26 is disposed at an upper location of cylindrical compactor body 14 on each side thereof to provide a low clearance mechanism. Since compactor body 14 is generally cylindrical, lifting mechanism 26 extends only slightly above an upper imaginary plane defined by the top of container 14.

Each lifting mechanism 26 comprises three principle functioning components. The first, a hydraulically operated cylinder 30 is pivotably secured to compactor body 14 at a butt or proximal end 32. An extendable piston of cylinder 30 extends to a distal end 34 which is pivotably attached to a bell crank 38. Secondly, bell crank 38 is pivotably secured at a fixed pivot point 40 and disposed between a pair of parallel compactor body pivot plates 42 and 44. Thirdly, a pair of parallel cam plates 48 are secured to a respective upper portion of tailgate 24 and about a laterally extending rigid frame member 50. The opposite end of each cam plate 48 is functionally disposed about pivot point 40 of bell crank 38. Further, a distal end 52 of bell crank 38 is pivotably disposed in and between a kidney-shaped slot defined in a lower midsection of each cam plate 48 as will be described shortly.

Figure 5:
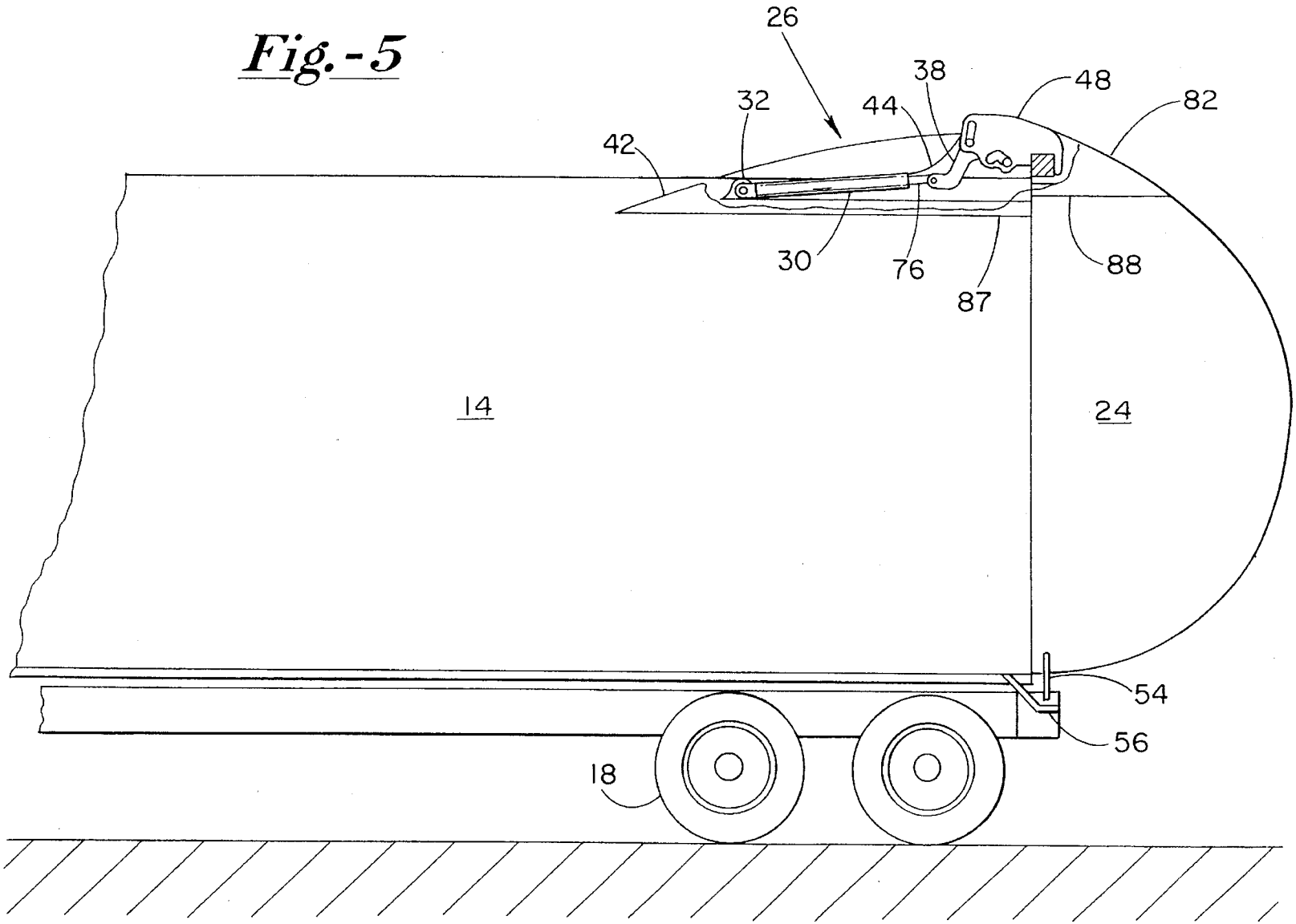
FIG. 5 is a side elevational view of the refuse truck body with the lifting and hinging mechanism in the same position as that shown in FIG. 4 illustrating the latching pins lifted clear of the latching loop secured to the truck frame.

Tailgate 24 is shown in the fully lowered and locked position with a respective tailgate latch pin or spur 54 disposed through and retained by a U-shaped latch member 56 secured to compactor body 14 as shown. In operation, lifting and hinging mechanism 26 first serves to lift tailgate 24 upwardly in the vertical direction such that each pin 54 clears respective latch 56 (see FIG. 5), whereby tailgate 24 is then subsequently pivoted rearwardly and upwardly to expose the refuse cavity within compaction body 14. The operation and details of lifting and hinging mechanism 26 will now be described in considerable detail in view of the several following figures illustrating kinematics of the present invention.

Figure 2:
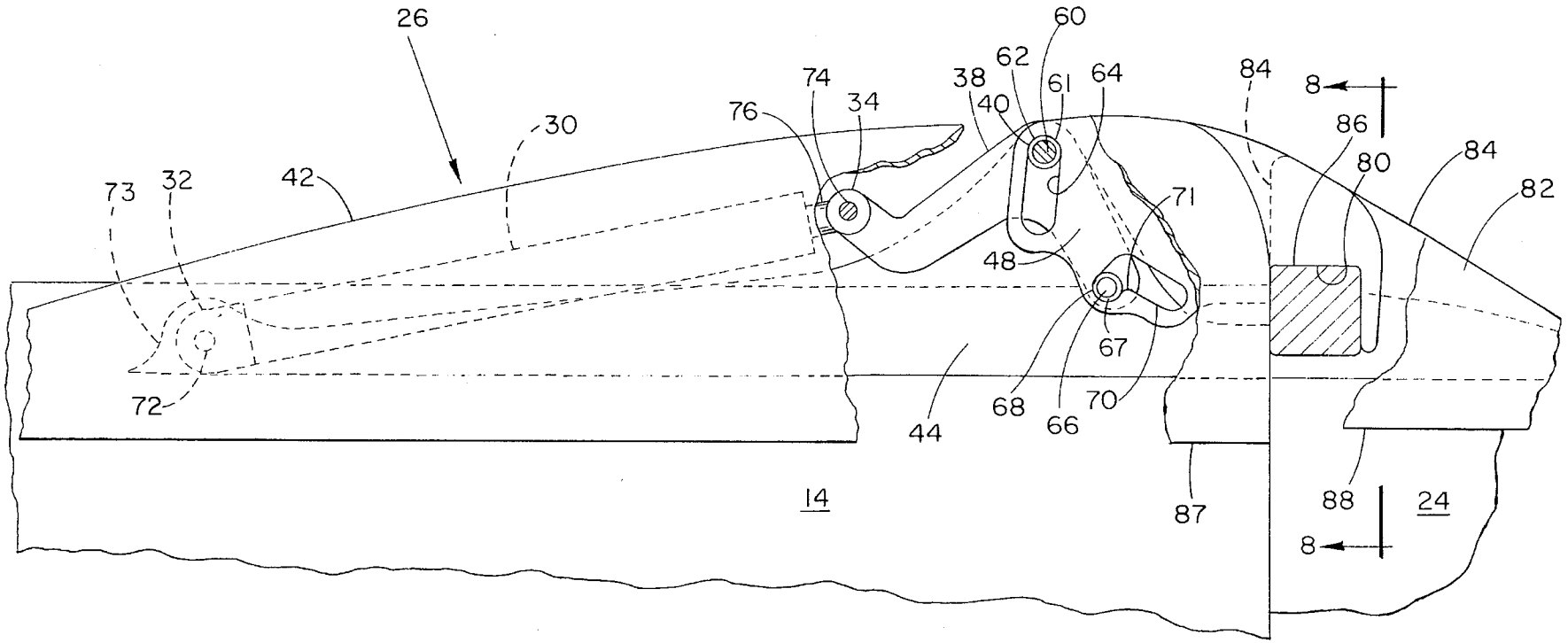
FIG. 2 is a blown-up sectional view of the lifting and hinging mechanism shown in FIG. 1 illustrating the functional relationship of the bell crank to the hydraulic cylinder and one cam plate when the tailgate is in the closed and locked position.

Referring to FIG. 2, a partial sectional view of lifting and hinging mechanism 26 disposed on the near side of compactor body 14 is shown. The rounded outer pivot plate 42 is shown partially sectioned to expose the critical features of bell crank 38 and the outer cam plate 48. Also shown in the sectioned portion of outer plate 42 is the inner surface of the rounded inner pivot plate 44. Both inner and outer pivot plates 42 and 44 are comprised of a steel plate and are disposed parallel to one another, each plate secured along a lower edge thereof by welding to the outer surface of cylindrical compactor body 14. An upper cam pivot shaft 60 is laterally disposed between inner opposing surfaces of inner and outer plates 42 and 44 and secured with retaining hardware (not shown). Bell crank 38 has a generally S-shape with a conforming aperture 61 defined through a midsection thereof at the bend which is journaled for rotation about the upper cam pivot shaft 60 (see FIG. 9). A pair of rollers 62 providing bearing surfaces are disposed over pivot shaft 60 in a sleeve-type fit on each side of bell crank 38. Shaft 60 and each roller 62 are received within a vertically oriented longitudinal slot 64 of respective cam plate 48 as shown.

Similarly, a lower cam shaft 66 is also rotatably disposed through a conforming aperture 67 defined through the distal end 52 of bell crank 38. (See FIG. 9). A pair of load bearing rollers 68 are axially disposed over cam shaft 66 on each side of bell crank 38 in a sleeve-type arrangement, each roller received and constrained within a respective kidney-shaped slot 70 defined in a lower central portion of each cam plate 48. As the piston of cylinder 30 is extended, each of pivot shaft 60 and lower cam shaft 66, along with the corresponding rollers 62 and 68, will slide within respective slots 64 and 70 as bell crank 38 is rotated in the counterclockwise direction about fixed pivot point 60 as can be seen in the following figures. Extension of the cylinder rod imposes a counterclockwise direction due to the axis of the cylinder extending below pivot point 60, as shown.

The proximal or butt end 32 of cylinder 30 is rotatably secured between each pivot plate 42 and 44 via cylinder pin 72. Each end of cylinder pin 72 has a corresponding boss 73 secured by retaining hardware (not shown) to the opposing inner surfaces of pivot plates 42 and 44 (see FIG. 8). A second cylinder pin 74 is rotatably disposed through an aperture 75 in proximal end 34 of bell crank 38 as shown. (See FIG. 9). Cylinder 30 has an extendable elongated piston 76 axially disposed therewithin which extends in the axial direction to selectively rotate bell crank 38 counterclockwise. Cylinder 30 is hydraulically and selectively controlled by on-board hydraulics (not shown) of truck 10 in a well known manner.

Each of cam plates 48 are disposed parallel to one another and include a square-shaped notch 80 at a distal end thereof. Each of the lifting hinging mechanisms 26 is provided with a pair of pivot plate supports shown as outer pivot support plate 82 and inner pivot support plate 84. A solid rectangular rigid frame member 86 laterally extends between each support plate 82 and 84 proximate compactor body 14 and is welded at each end to the opposing inner surfaces of support plates 82 and 84. Conforming notch 80 of each cam plate 48 is fixedly secured about frame 86 and between support plates 82 and 84 and welded thereto. Thus, when each cam plate 48 is rotated upwardly and about fixed pivot point 60, frame member 86, along with support plates 82 and 84 which are fixedly secured to tailgate 24, are all caused to rotate about pivot point 60. Due to the novel arrangement and design of lifting mechanism 26, each cam plate 48 and therefore tailgate 24 will be first urged vertically upwardly to unlatch tailgate 24 from compactor body 14 at 56 as will now be discussed, especially in view of FIGS. 2–7.

Still referring to FIG. 2, tailgate 24 is shown in the fully lowered and locked position. As can be seen, the lower edge 87 of outer pivot plate 42 and lower edge 88 of support plate 82 nearly intersect one another. (See also FIG. 1). In this position, each cam plate 48 of respective lifting mechanism 26 is positioned such that fixed pivot shaft 60 and corresponding rollers 62 are disposed at the upper location of each respective pivot slot 64 as shown. Lower cam shaft 66 and corresponding rollers 68 are positioned at the left or proximal end of each laterally extending kidney-shaped slot 70, as shown, to the left and slightly below the top of a center locking shoulder shown at 71. Due to this arrangement, an over-center locking mechanism is provided since each cam plate 48 and tailgate 24 will remain in the lowered and locked position even when unwanted upward forces are generated on the tailgate, such as the truck hitting a bump during driving. This is because both an upward and lateral force would be required to urge cam shaft 66 up and over shoulder 71, and bell crank 38 would have to rotate. Rotation of bell crank 38 only occurs upon extension of cylinder rod 76, which is hydraulically locked when not operated. Consequently, locking pins 54 remain constrained within corresponding brackets 56. Further, even if the actuating cylinder 30 relaxes its holding force, the bell crank 38 remains in a locked position due to shoulder 71 restraining shaft 66, and tailgate 24 is inhibited from being urged upwardly. Thus, tailgate 24 cannot inadvertently be separated from compactor body 14.

Figure 3:
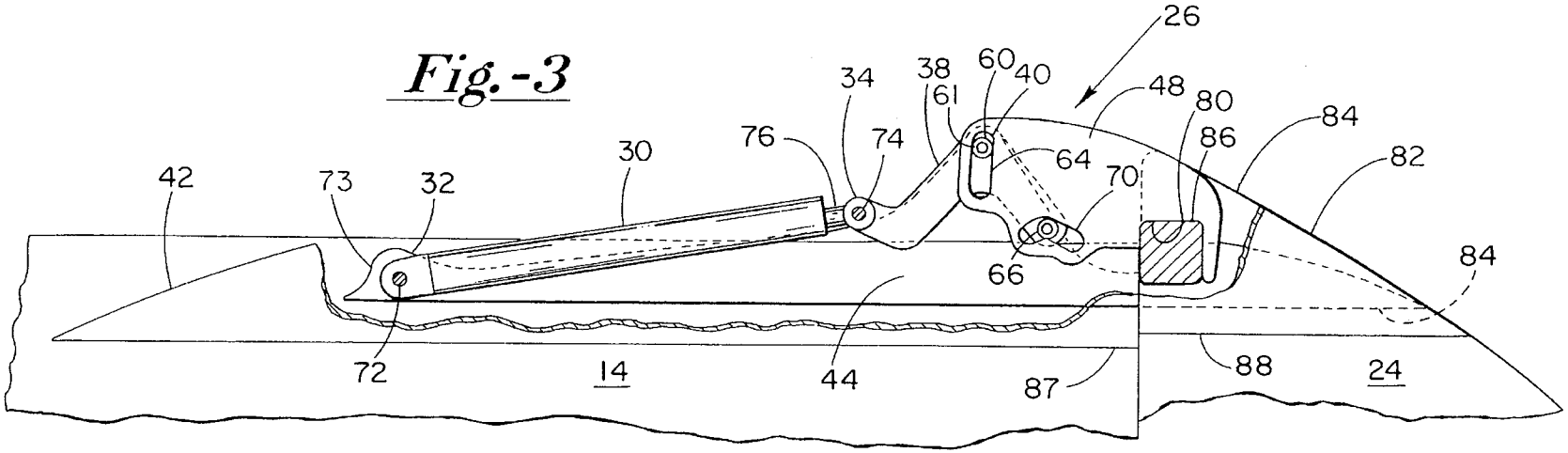
FIG. 3 is also a section view of the lifting and hinging mechanism with the tailgate partly raised but not rotated, wherein the cam and pivot shafts are disposed at intermediate locations of the respective cam slots.

Referring now to FIGS. 3–7, kinematic views of lifting and hinging mechanism 26 are shown to illustrate the sequential lifting and opening operation of tailgate 24. First, referring to FIG. 3 it can be seen that piston 76 of cylinder 30 is slightly extended by the truck hydraulic system (not shown) to slightly rotate bell crank 38 in the counterclockwise direction. This slight rotation of bell crank 38 causes lower cam shaft 66 rotatably disposed through a distal end thereof to rotate counterclockwise as well. Lower cam shaft 66 and corresponding rollers 68 will be caused to lift each cam plate 48 upwardly by exerting a force along the upper edge "A" (see FIG. 10) of each kidney-shaped slot 70. As shown in FIG. 3, each cam plate 48 and tailgate 24 are correspondingly urged slightly upward from the fully locked position (note plate edges 87 and 88). Both pivot pin 60 and cam shaft 66 are disposed in a midsection of respective slots 64 and 70.

Figure 4:
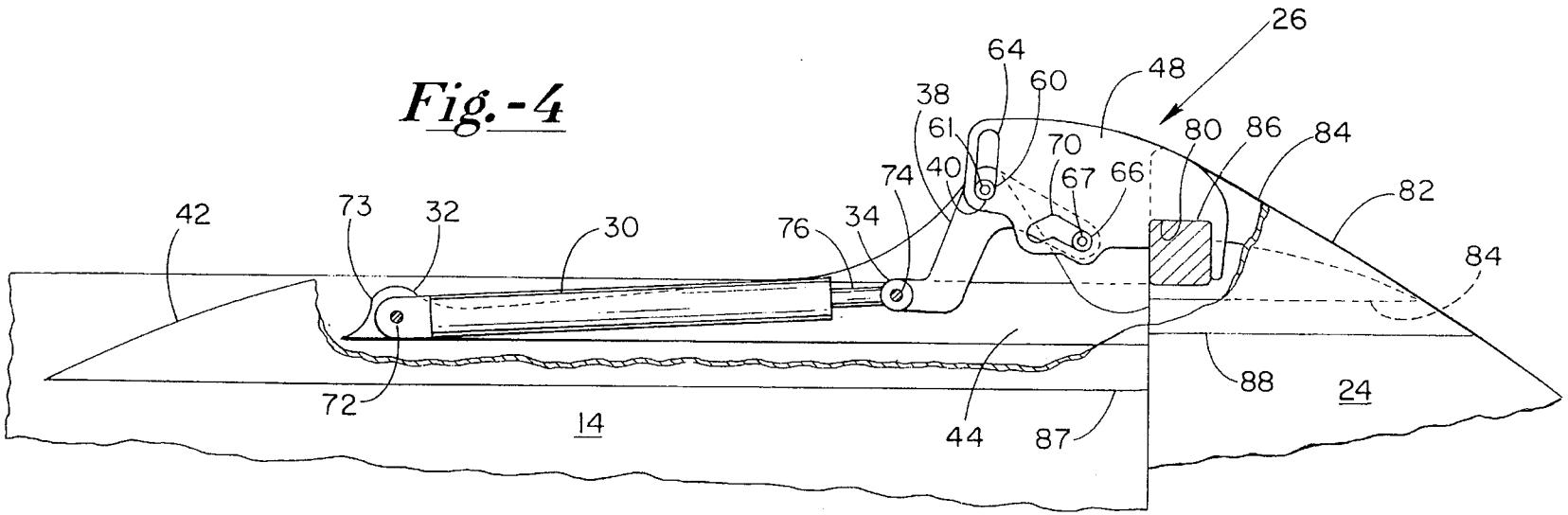
FIG. 4 is a sectional view of the combination lifting and hinging mechanism with the tailgate fully raised but not rotated, wherein the respective cam and pivot shafts are now disposed at opposite ends of the respective slot from that shown in FIG. 2.

Referring now to FIG. 4, piston 76 is extended slightly further by the hydraulics to further rotate bell crank 38 in the counterclockwise direction. As shown in FIG. 4, tailgate 24 is now fully raised and unlocked from compactor body 14 at 56 as each latch pin 54 on each side of tailgate 24 is lifted clear of the respective side spur latch 56. (See FIG. 5). As shown in FIG. 4, upper fixed pivot pin 60 and its corresponding sleeve rollers 62 are now disposed in the lowermost position within respective slots 64 of each cam plate 48. Also shown is lower cam shaft 66 and the corresponding rollers 68 now disposed at the distal end of each respective kidney-shaped slot 70. During the operation from FIG. 2–4, tailgate 24 is raised vertically from the lowermost and locked position to the fully raised position, but is not rotated as shown in FIG. 4. During this unlatching phase, each cylinder 30 approaches a true horizontal position. The proximal end 32 of each cylinder 30 remains pivotally but securingly disposed between the proximal end of respective pivot plates 42 and 44, the proximal or butt end 32 serving as the leverage point for mechanism 26.

Figure 6:
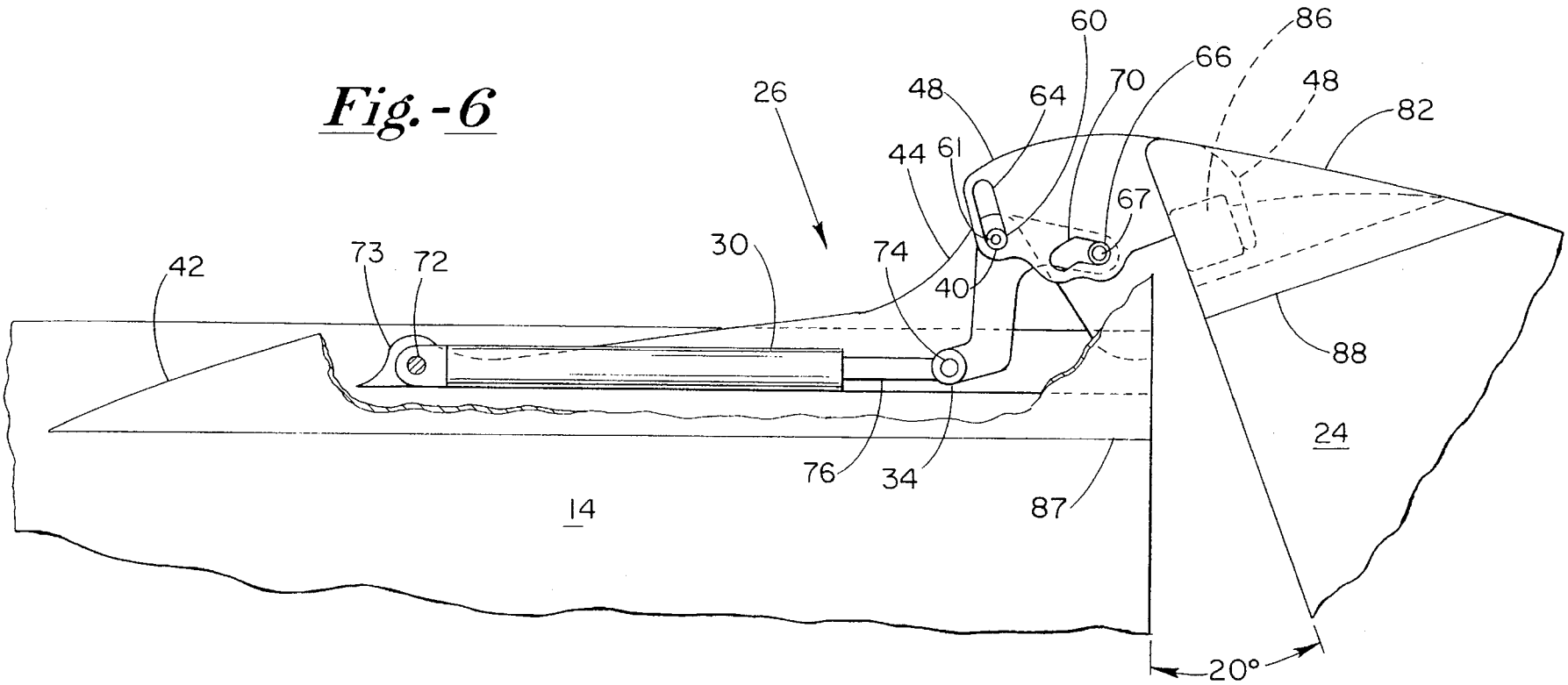
FIG. 6 is a sectional view of the lifting and hinging mechanism illustrating the hydraulic cylinder piston partially extended and disposed in the horizontal direction with the tailgate partially rotated and fully raised.

Referring now to FIG. 6, the pivoting of tailgate 24 and bell crank 38 is continued. As shown in FIG. 6, each piston 76 is now further extended by the hydraulics such that hydraulic cylinder 30 is horizontal and tailgate 24 is partially rotated about 20°. Pivot pin 60 and rollers 62 remain at the lower end of cam plate slot 64, and lower cam shaft 66 and rollers 68 remain at the distal end of respective kidney-shaped slot 70. However, pivot pin 60 remains secured in a fixed position between outer pivot plate 42 and inner pivot plate 44 as bell crank 38 is rotated thereabout in the counterclockwise direction.

Figure 7:
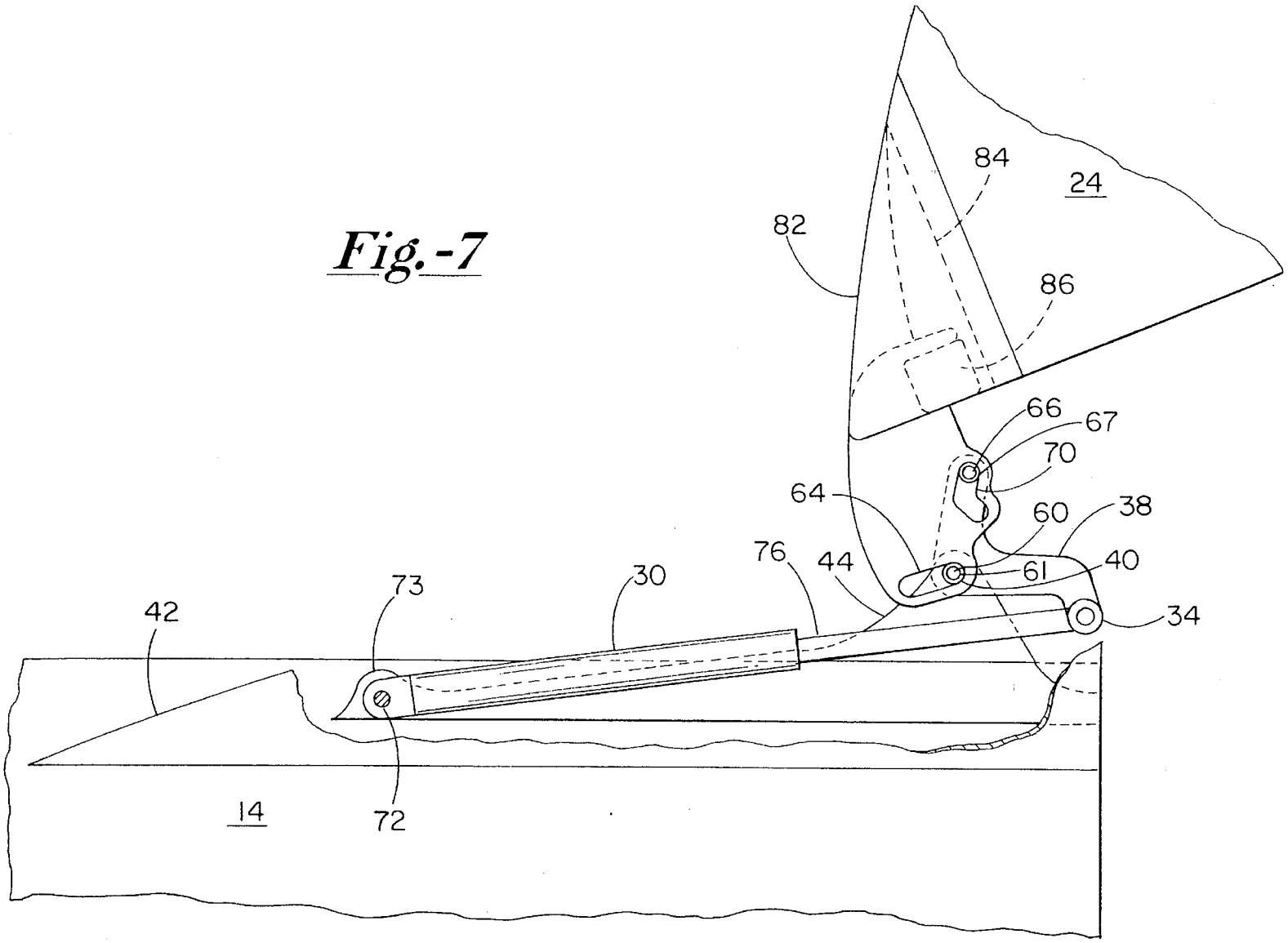
FIG. 7 is a sectional view of the lifting and hinging mechanism with the hydraulic cylinder piston fully extended and the bell crank fully rotated counterclockwise such that the tailgate is fully raised to facilitate discharging refuse from the compactor body.

Referring now to FIG. 7, tailgate 24 is shown in the fully raised and rotated position. As shown, hydraulic cylinder 30 and associated piston 76 are elevated upwardly slightly from the horizontal plane and bell crank 38 is fully rotated such that lower cam shaft 66 is almost disposed above fixed pivot shaft 60. Again, pivot shaft 60 remains at the lower end of each slot 64, and lower cam shaft 66 remains at the distal end of each kidney-shaped slot 70. In the fully rotated position, tailgate 24 is rotated clear of compactor body 14 such that the refuse contained within body 14 can be expelled therefrom using ejector 22 in a well known manner.

Figure 8:
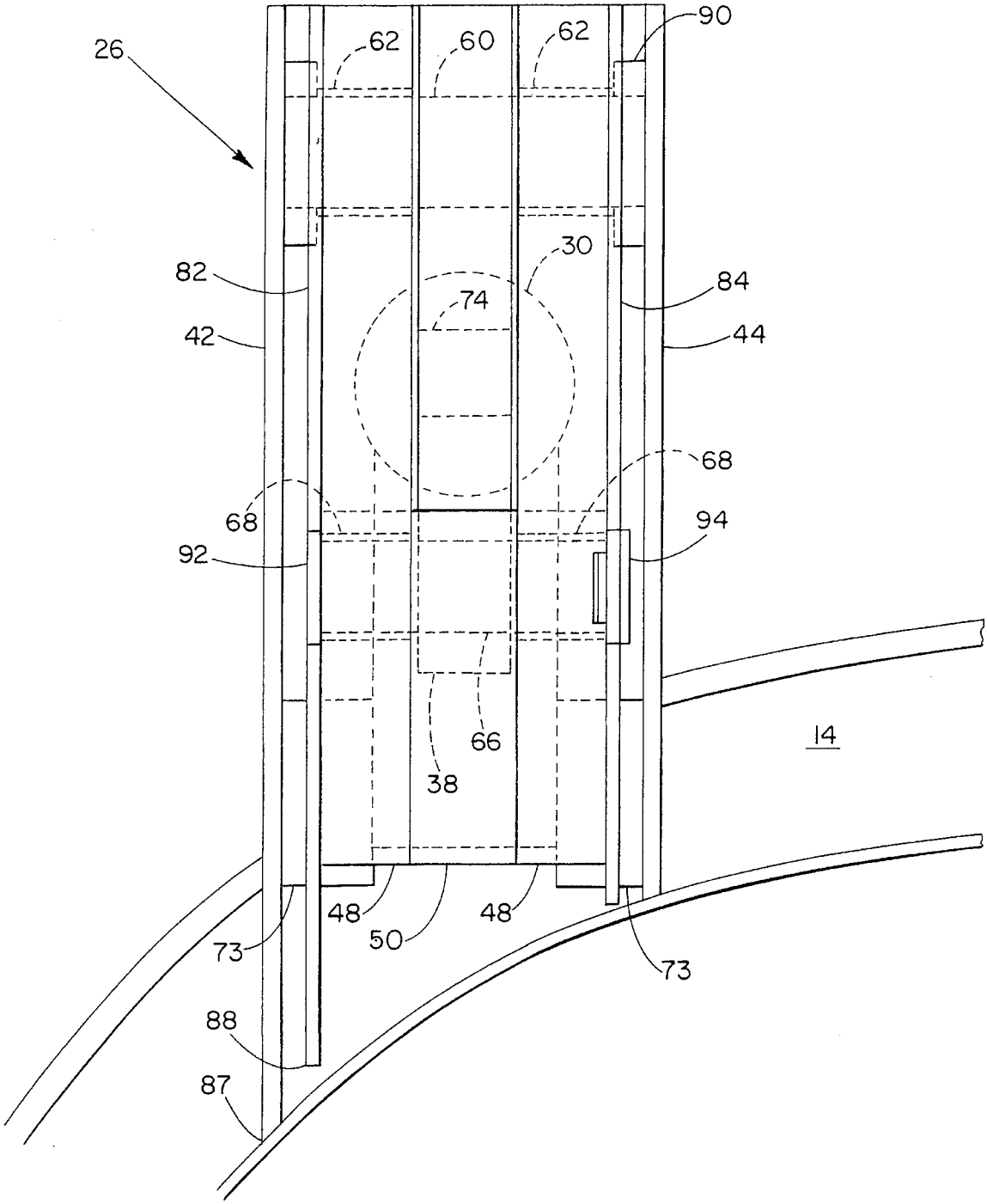
FIG. 8 is an end view taken along line 8—8 shown in FIG. 2 illustrating the relationship of the bell crank sandwiched between the pair of cam plates, wherein the cam plates are secured to and sandwiched between a pair of tailgate support members, and the entire assembly sandwiched for pivoting between an inner and outer pivot plate which is secured to the storage body at the bottom thereof.

Referring now to FIG. 8 which is an end view 8—8 taken in FIG. 2, it can be seen bell crank 38 sandwiched in close tolerance between each cam plate 48. The adjacent surfaces of bell crank 38 and each cam plate 48 are lubricated with grease to reduce any friction. Further it can be seen each cam plate 48 disposed between and in flush contact with the respective outer and inner pivot support plate 82 and 84. Again, each support plate 82 and 84 is secured to tailgate 24 by welding along the lower edge thereof. Each support plate 82 and 84 is welded to respective cam plate 48 at the opposing surfaces and serves to reinforce and support each respective cam plate 48 during the rotation procedure. FIG. 8 also illustrates outer pivot plates 42 and 44 disposed parallel to one another and sandwiching each cam plate 48 and bell crank 38 therebetween. As shown, each pivot plate 42 and 44 is welded along the lower edge thereof to the outer shell of body 14.

Further shown in FIG. 8 is upper pivot shaft 60 having a pair of plate support bosses 90 secured between and welded to the inside opposing surfaces of the outer end inner pivot plates 42 and 44. Bosses 90 are disposed at opposite ends of shaft 60 and form an integral portion thereof. Lower cam shaft 66 can be seen disposed through only each cam plate 48 and aperture 67 at the distal end of bell crank 38. Shaft 66 has an enlarged head or boss 92 at one end, and a threaded enlarged cap 94 at the other end for constraining shaft 66 within slots 70. Also shown in phantom is respective rollers 62 and 68 for facilitating rotation of pivot 60 and cam shaft 66, respectively, therewithin through rotation of bell crank 38.

The pair of support bosses 73 rotatably secured to the butt end of cylinder 30 are shown each secured via welding to the inner opposing surfaces of outer pivot plate 42 and inner pivot plate 44.

Again, a lifting and hinging mechanism 26 is provided at each side of compactor body 14 and which operates in unison with the other while together lifting and rotating tailgate 24. Each is disposed on each side of the center line of cylindrical compactor body 14 such that the upper edge of cam plates 48 and pivot plates 42 and 44 extend only slightly above the top of compactor body 14.

Figure 9:
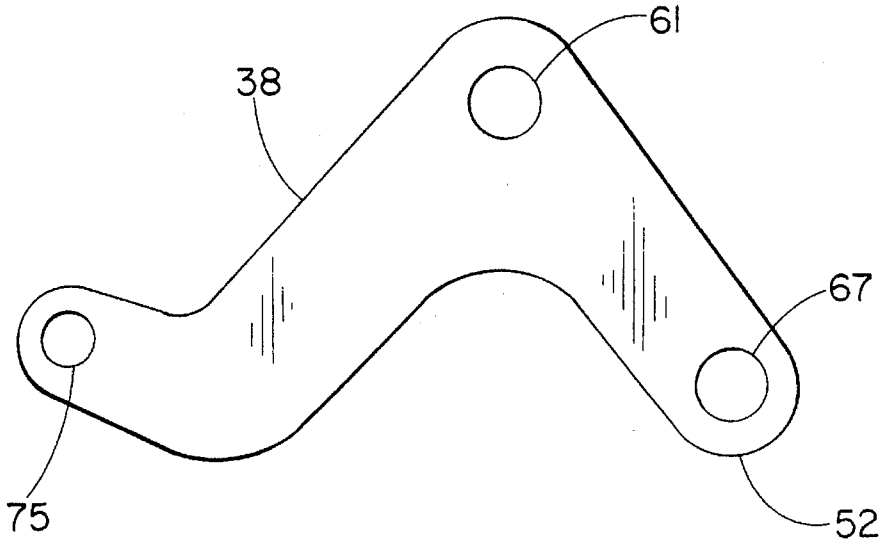
FIG. 9 is a side view of the bell crank.

Referring now to FIG. 9, a detailed drawing of bell crank 38 is shown illustrating its generally S-shape and boomerang shape. Bell crank 38 is comprised of a rigid material such as steel and has a thickness of about 1¼ inch.

Figure 10:
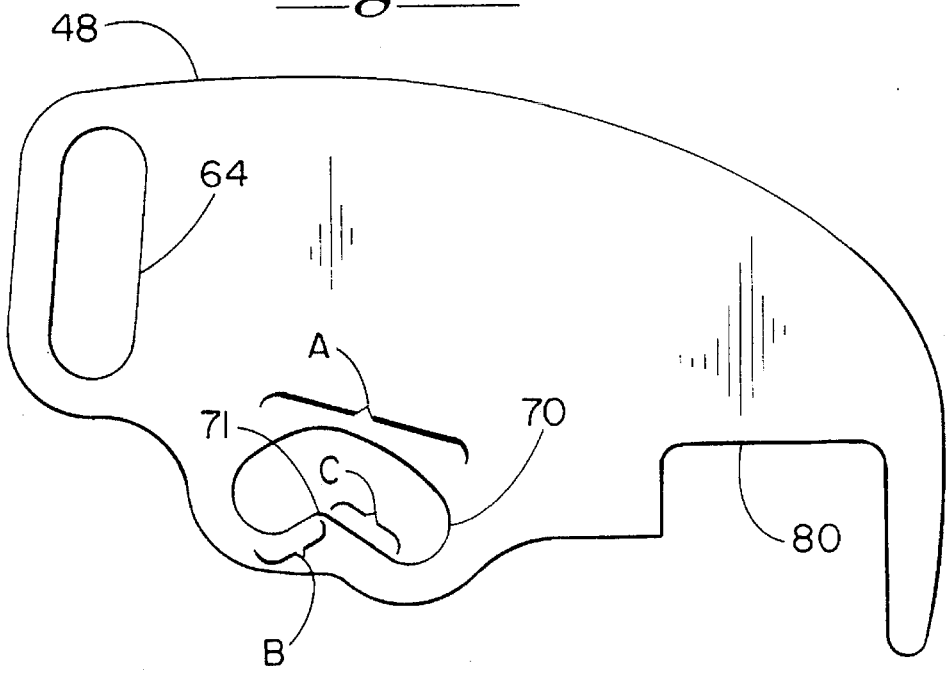
FIG. 10 is a detailed side view of one cam plate including a pivot pin slot and a kidney-shaped slot adapted to cooperate with the lower cam shaft of the bell crank.

Referring now to FIG. 10, a detailed drawing of one cam plate 48 is shown, which cam plate is also comprised of a rigid material such as steel and is also approximately 1¼ inch in thickness. Reference A indicates the raising surface of kidney-shaped slot 70 upon which lower cam shaft 66 is urged against during the lifting and unlatching of tailgate 24 as previously discussed. Reference B illustrates the locking surface of the kidney-shaped slot which is urged against lower cam shaft 66 and which prevents accidental lifting of tailgate 24, such as when truck 20 drives over a bump. Reference C illustrates the lowering surface of the kidney shaped slot which shaft 66 urges against when the tailgate is closed and pins 54 inserted into brackets 56. The portion of slot 70 on each side of the shoulder 71 tapers downwardly. The portion of the slot 70 to the right of shoulder 71 is substantially longer than the locking portion extending left of shoulder 71.

One of the principal features of the present invention is its simplicity. Only three moving principal components are required for mechanism 26, namely, the extendable hydraulic cylinder 30, the rotatable bell crank 38, and the pivotable cam plate 48. Thus, the mechanism is highly reliable and not subject to become jammed easily. Further, the mechanism is relatively inexpensive due to the few components required.

Further, the lifting and hinging mechanism 26 is disposed at an upper portion of each side of compactor body 14 and is thus not easily damaged by personnel or subject to being scraped should truck 12 be brushed against a rigid surface which would otherwise damage some of the components.

Still yet another principal feature of the present invention is that since lifting mechanism 26 is disposed on an upper surface of each side of the central line of compactor body 14, the dimensions of compactor body 14 can be maximized in the lateral and vertical directions to the limits allowed by the Department of Transportation.

Still yet another feature of the present invention is the over-center locking mechanism provided by the laterally extending kidney-shaped slot 70 having a shoulder 71. Kidney-shaped slot 70 ensures the tailgate 24 cannot be jarred loose from compactor body 14 through unintended forces, even if the actuating cylinder relaxes its holding force. The locking and latching feature of pins 54 and latches 56 operate in combination with the lifting and over-center locking feature. Namely, a locking pin 54 or spur is provided on each side of tailgate 24 and is secured within spur latch 56 when tailgate 24 is in the non-rotated position. The unique lifting feature of mechanism 26 facilitates the quick and easy unlatching of the tailgate 24 prior to rotation. Such a latching mechanism is also accomplished with a few number of components, is reliable, and easy to use.

It is to be recognized that for purposes of illustration lifting mechanism 26 has been shown adapted to the tailgate assembly. However, the present invention is also ideally adapted to be used with a front loader or side loader refuse truck, or any body with a hinging door using latching spurs to secure the tailgate to the compactor body.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For instance, a modified shape for slot 70 could be provided which provides for an over-center locking feature but which is not purely a kidney-shaped slot. Moreover, a pair of bell-cranks 38 could be used, one positioned each side of a single pivot plate 42. Hence, limitation to the number or combination of parts shown is not to be inferred.

I claim:

1. A refuse truck body, comprising:

(a) a storage body for storing refuse;

(b) a tailgate coupled to the storage body for pivotal movement between an open and closed position, said tailgate forming a closure with said storage body in its closed position; and (c) means located on a top surface of said storage body for hinging and moving said tailgate between the open and closed position, comprising:

(i) an arm having a midsection pivotably attached to an upper portion of said storage body to define a pivot point, said arm having a proximal end and distal end disposed on opposite sides of said pivot point, said arm distal end pivotably connected to an upper portion of said tailgate;

(ii) means connected to said storage body and said arm proximal end for pivoting said arm about said pivot point to move the tailgate between the open and closed position; and (iii) an over-center locking means for securing said tailgate in the-closed position.

2. A refuse truck body, comprising:

(a) a storage body for storing refuse;

(b) a tailgate coupled to the storage body for pivotal movement between an open and closed position, said tailgate forming a closure with said storage body in its closed position; and (c) means for hinging and moving said tailgate between the open and closed position, comprising:

(i) an arm having a midsection pivotably attached to an upper portion of said storage body to define a pivot point, said arm having a proximal end and distal end disposed on opposite sides of said pivot point, said arm distal end pivotably connected to an upper portion of said tailgate;

(ii) means connected to said storage body and said arm proximal end for pivoting said arm about said pivot point to move the tailgate between the open and closed position; and (iii) an over-center locking means for securing said tailgate in the closed position, said over-center locking means includes a frame member coupled to the tailgate upper portion, said frame member having a first slot, said distal end of said arm having a first pin pivotably disposed therethrough and into said first slot such that upon pivoting said arm using said pivoting means said tailgate is first elevated vertically from the closed position before subsequently moved about said pivot point to the open position.

3. The refuse truck body as specified in claim 2 wherein said tailgate frame member has a second slot, and said arm has a second pin pivotably disposed therethrough and into said frame member second slot.

4. The refuse truck body as specified in claim 2 wherein said first slot has a generally kidney shape to provide said over-center locking means.

5. The refuse truck body as specified in claim 3 wherein said second slot is generally linear and extends in a generally vertical direction when said tailgate is in the closed position.

6. The refuse truck body as specified in claim 1 wherein said pivoting means comprises an extendable hydraulic cylinder moving between said top surface of said storage body and said proximal end of said arm.

7. The refuse truck as specified in claim 6 wherein said pivoting means is pivotably connected to said proximal end of said arm at a location below an imaginary line extending horizontally through said pivot point when said tailgate is in the closed position, wherein said arm is pivoted in the counterclockwise direction by said hydraulic cylinder when extended to move said tailgate to the open position.

8. The refuse truck body as specified in claim 2 wherein a pair of said frame members are provided, one on each side of said arm with said arm rotatably secured therebetween.

9. The refuse truck as specified in claim 1 wherein said storage body includes a pair of parallel plates secured thereto with said arm pivotably secured therebetween.

10. The refuse truck body as specified in claim 1 wherein a pair of said hinging and moving means are provided on said top surface of said storage body at opposite sides thereof.

11. The refuse truck body as specified in claim 10 wherein said storage body has a generally cylindrical shape with a horizontally extending axis.

12. A refuse truck body, comprising:

(a) a storage body for storing refuse;

(b) a tailgate coupled to the storage body for pivotal movement between an open and closed position, said tailgate forming a closure with said storage body in its closed position; and (c) means for hinging and moving said tailgate between the open and closed position, comprising:

(i) an arm having a midsection pivotably attached to an upper portion of said storage body to define a pivot point, said arm having a proximal end and distal end disposed on opposite sides of said pivot point, said arm distal end pivotably connected to an upper portion of said tailgate, said arm has a generally S-shape and comprises a bell crank;

(ii) means connected to said storage body and said arm proximal end for pivoting said arm about said pivot point to move the tailgate between the open and closed position; and (iii) an over-center locking means for securing said tailgate in the closed position.

* * * * *